US005169258A

United States Patent [19]

Raynak

[11] Patent Number: 5,169,258

[45] Date of Patent: Dec. 8, 1992

[54] PIPE CONNECTORS FOR STRUCTURE FABRICATION

[76] Inventor: Larry J. Raynak, 544 Georgia Ave., Palo Alto, Calif. 94306

[21] Appl. No.: 648,104

[22] Filed: Jan. 31, 1991

[51] Int. Cl.[5] ..... F16D 1/00

[52] U.S. Cl. ..... 403/170; 403/176; 403/178

[58] Field of Search ..... 403/170, 171, 172, 173, 403/174, 175, 176, 177, 178

[56] References Cited

U.S. PATENT DOCUMENTS

| | | | |
|---|---|---|---|
| 2,208,049 | 7/1940 | Pajeau . | |
| 2,609,638 | 9/1952 | Lindenmeyer . | |
| 2,709,318 | 5/1955 | Benjamin . | |
| 2,863,682 | 12/1958 | Canepa . | |
| 4,044,497 | 8/1977 | Bettens | 403/170 X |
| 4,090,798 | 5/1978 | Barton . | |
| 4,406,560 | 9/1983 | Pickering . | |
| 4,673,308 | 6/1987 | Reilly . | |
| 4,844,648 | 7/1989 | Fentiman | 403/171 |
| 4,874,708 | 10/1989 | Daus, Jr. | 403/176 X |

FOREIGN PATENT DOCUMENTS

| | | | |
|---|---|---|---|
| 1249598 | 9/1967 | Fed. Rep. of Germany . | |
| 2806764 | 8/1979 | Fed. Rep. of Germany | 403/171 |
| 1514258 | 1/1968 | France | 403/175 |
| 2187812 | 9/1987 | United Kingdom | 403/171 |

*Primary Examiner*—Andrew V. Kundrat
*Attorney, Agent, or Firm*—Townsend and Townsend

[57] ABSTRACT

A connector kit for construction of structures from pipe such as PVC pipe. The connectors include a body (2) through which an aperture (8) is provided. Extending from the body are pins (4,6) onto which a pipe (16) is attached by sliding the pipe over the extensions. The aperture in the body is adapted to receive one of two types of pins. The first of the two types of pins (12) is of sufficient length that it will allow slotted ends thereon to extend out of both the top and bottom of the body when inserted. The second type of pin (14) will extend out of only one end of the body when inserted therein. The two pin types allow the use of a single body type for internal and external connections within a structure, but also on top or bottom portions of a structure.

8 Claims, 6 Drawing Sheets

PIPE CONNECTORS FOR STRUCTURE FABRICATION

BACKGROUND OF THE INVENTION

The present invention relates to the field of structure fabrication and devices therefor. More specifically, in one embodiment the invention provides pipe connectors for construction of structures from pipe such as polyvinyl chloride (PVC) and other plastic pipe.

PVC pipe and other types of pipe are well known. In addition to the conventional applications of such pipe to the transport of water, air and other materials, pipe has often been utilized in the construction of structures since it provides a readily available, inexpensive, easy to utilize, reasonably sturdy, and versatile structural material. Merely by way of example, PVC pipe has been utilized in the construction of lawn furniture and other outdoor structures, in large part because it requires little maintenance without the deterioration problems associated with metal and wood.

In some instances, structures made of plastic pipes have used conventional pipe connectors in their fabrication. For instance, such structures may use a conventional 90° ell at a corner of such structures. While meeting with substantial success, such applications of conventional pipe connectors has also presented substantial difficulties. For example, each type of connection must be uniquely fabricated. This presents difficulties because a primary goal of the use of PVC pipe in construction is low cost, but the need to fabricate a vast array of connectors tends to increase this cost.

Other pipe connector systems have also been proposed which are especially suited for structural fabrication using pipe. For example, German Patent No. 1,249,598 discloses a pipe connector system which includes a body from which various extensions are provided. The extensions are slotted, for compression when a pipe is connected to the extension for tight gripping. However the pipe connector of German Patent No. 1,249,598 suffers from many of the limitations noted above. In particular, the pipe connector system disclosed therein requires the fabrication of a unique connector for each application in a structure. For example, it would be necessary to fabricate a different connector for internal corners than for external corners in a structure.

Other pipe connector systems include those of U.S. Pat. No. 2,863,682 (Canepa) which discloses a pipe connector system with a body which may be split and U.S. Pat. No. 4,090,798 (Barton) discloses a connector with split ends.

From the above it is seen that an improved pipe connector assembly is desired for construction of structures from pipe.

SUMMARY OF THE INVENTION

An improved connector system for construction of structures from pipe such as PVC pipe is provided by virtue of the present invention. The connectors include a body through which an aperture is provided. Extending from the body are extensions onto which a pipe is attached by sliding the pipe over the extensions. The extensions optionally contain slots such that the extensions may be compressed when they are inserted into the pipe for a tight fit.

The aperture in the body is adapted to receive one of two types of pins. The first of the two types of pins is of sufficient length that it will allow slotted ends thereon to extend out of both the top and bottom of the body when inserted, preferably including a pin stop at an intermediate point for proper positioning. The second type of pin is of a length that it will extend out of only one end of the body when inserted therein. The second type of pin also includes a cap to limit movement of the connector into the body aperture. With this arrangement of parts, a single pipe connector may be used not only on internal portions of a structure, but also on top or bottom portions of a structure, enabling substantially greater versatility than with prior known devices in which custom pieces would be required for both locations.

Accordingly, in one embodiment the invention provides a connector kit for construction of structures using pipe including a plurality of first connector bodies comprising apertures of a first diameter and at least one pin extending therefrom, the at least one pin having a second diameter of substantially the inside diameter of the pipe; a plurality of first connector pins having a center portion of substantially the first diameter for insertion into the aperture, and first and second ends of the second diameter, the first and second ends extending from the body when the first connector pin is inserted into the first connector body; and a plurality of second connector pins having a first end of substantially the first diameter for insertion into the aperture and a second end of the second diameter, the second end extending from the body when the second connector pin is inserted into the first connector body.

A further understanding of the nature and advantages of the inventions herein may be realized by reference to the remaining portions of the specification and the attached drawings.

DESCRIPTION OF THE PREFERRED EMBODIMENTS

A. Connector Construction

Figure 1A:
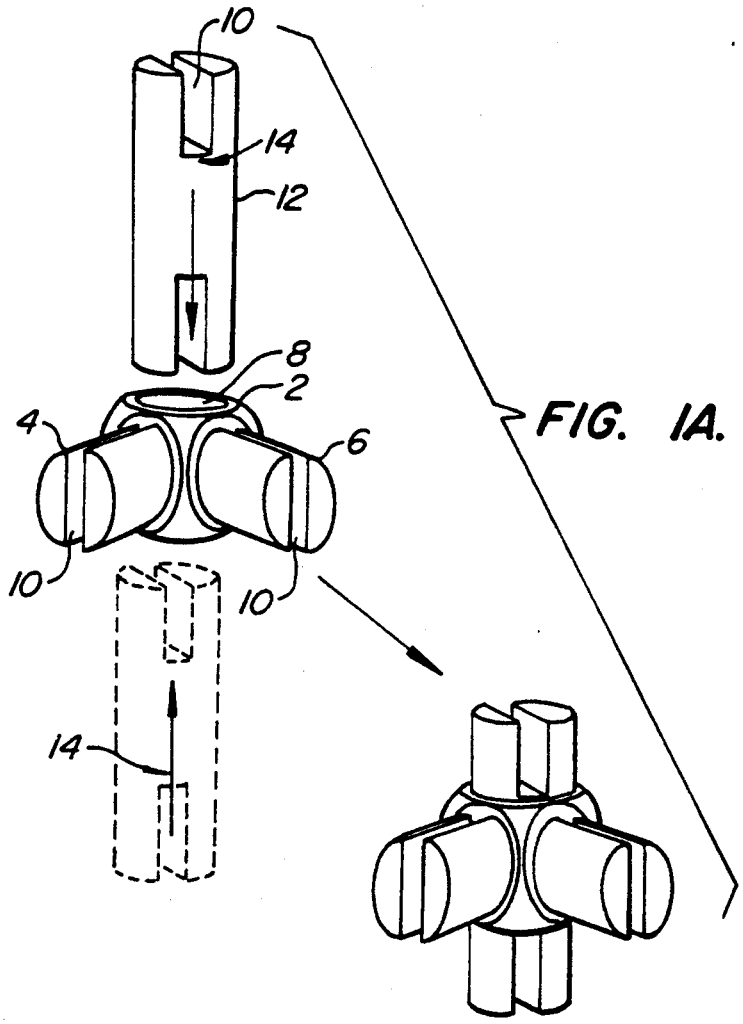
FIGS. 1A and 1B illustrate the two pin types disclosed herein and their use in connection with a first body type.
Figure 1B:
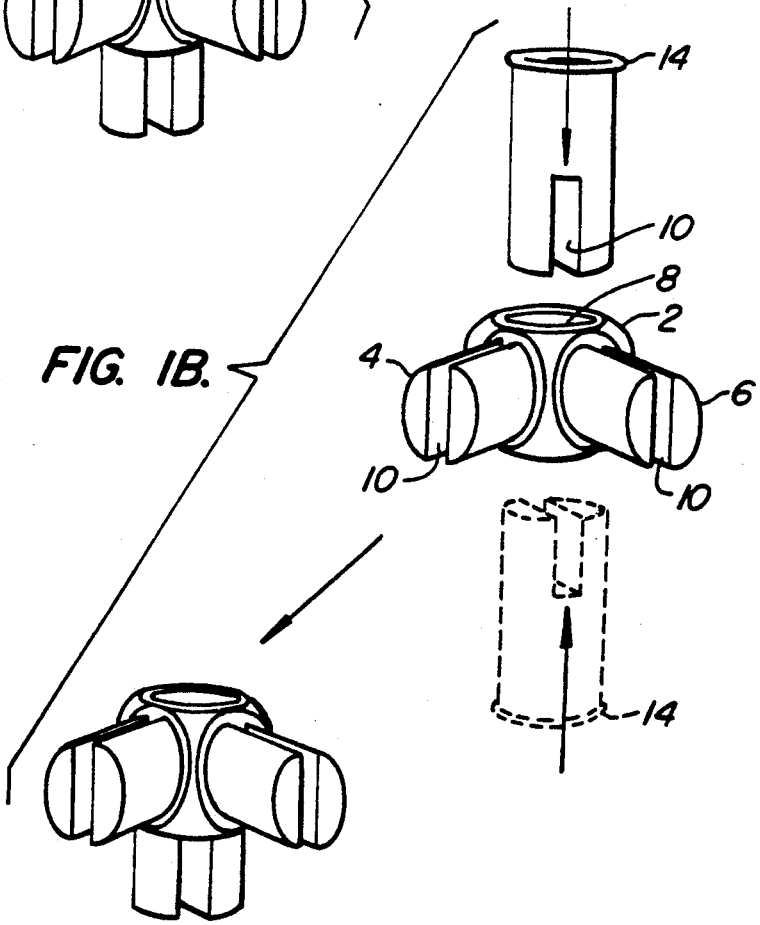

FIG. 1 illustrates one embodiment of the invention herein and, in particular, FIG. 1A illustrates a 90° ell with a first type of pin connection and FIG. 1B illustrates a 90° ell with a second type of pin connection. Referring to FIG. 1A, the invention provides for a connector body 2. In the particular embodiment shown in FIG. 1A, the connector is a 90° ell. First and second connection pins 4 and 6 extend from the body. The centerlines of the first and second connector pins are in the same plane and oriented substantially perpendicular to each other. The centerlines of both of the connector pins are oriented at right angles to the centerline of an aperture 8 which extends through the body 2.

Each of the pins 4 and 6 is generally cylindrical in shape, having a diameter of substantially the internal diameter of pipes to be connected thereto. The pins are connected rigidly to the body or formed integrally therewith. By "substantially" it is intended to mean herein a diameter which will provide a snug fit when the connector and the pipe to be connected, which in some cases will be slightly larger or slightly smaller than the inside diameter of the pipes. Preferably, the pins 4 and 6 contain slots 10 and the size of the pins in their uncompressed state is slightly larger than the inside diameter of pipes to be connected. When a pipe to be connected is slid over the pin 4 or 6, the slots allow for compression of the pin and a tight fit with the inside of the pipe. Preferably, the pins extend from the body about 1 to 2 inside pipe diameters away from the body.

The first pin type 12 is of sufficient length to extend beyond the body both above and below the body a distance about equal to the distance that the pins 4 and 6 extend from the body and is otherwise referred to herein as a "through" pin. In preferred embodiments the through pin type has a length of about the length of the body plus about 2 to 4 pipe diameters (such that they extend from the body about 1 to 2 diameters on each end). Both ends of the insertable pin 12 are of substantially the internal diameter of pipe to be inserted thereon, and have slots similar to the pins which extend from the body. The through pin type is insertable into the aperture in the body from above the body or, as shown in phantom in the lower portion of FIG. 1A, from below the body. Optionally, a stop or ridge 14 which will bind with the body and act as a limit for proper placement of the pin in the body is provided.

Preferably, the through pin has a diameter in its center portion of about the same diameter as the aperture 8 such that it binds tightly with the body. In use, as shown in FIG. 1A, the pin is inserted into the aperture in the body until the body contacts the stop 14. In some embodiments the pin will be glued or otherwise secured to the body for greater strength. The resulting structure contains pins extending directly up and down from the body as well as at right angles laterally from the body. The resulting structure shown in FIG. 1A will be especially suited for an internal corner connection within a pipe structure, i.e., for forming a corner in a structure which is not at the top or bottom edge of the structure.

The second type of insertable pin is illustrated in FIG. 1B and is otherwise referred to herein as an end pin. The same body as the one shown in FIG. 1A is utilized. However, the end pin is substantially shorter than the through pin shown in FIG. 1A and is slotted at only one end. A ridge or other stop 14 is provided at one end of the pin, while the other end of the pin is slotted and adapted to be inserted in a pipe.

In use, the end pin in FIG. 1B is inserted into the aperture in the body from either above the body or, as shown in phantom, below the body. The resulting structure has pins extending from the sides of the body at approximately 90° angles, but has a pin extending only upward or downward from the top or bottom of the body. The resulting structure shown in FIG. 1B is especially suited for corner connections at, for example, the top or bottom of a pipe structure.

Figure 2:
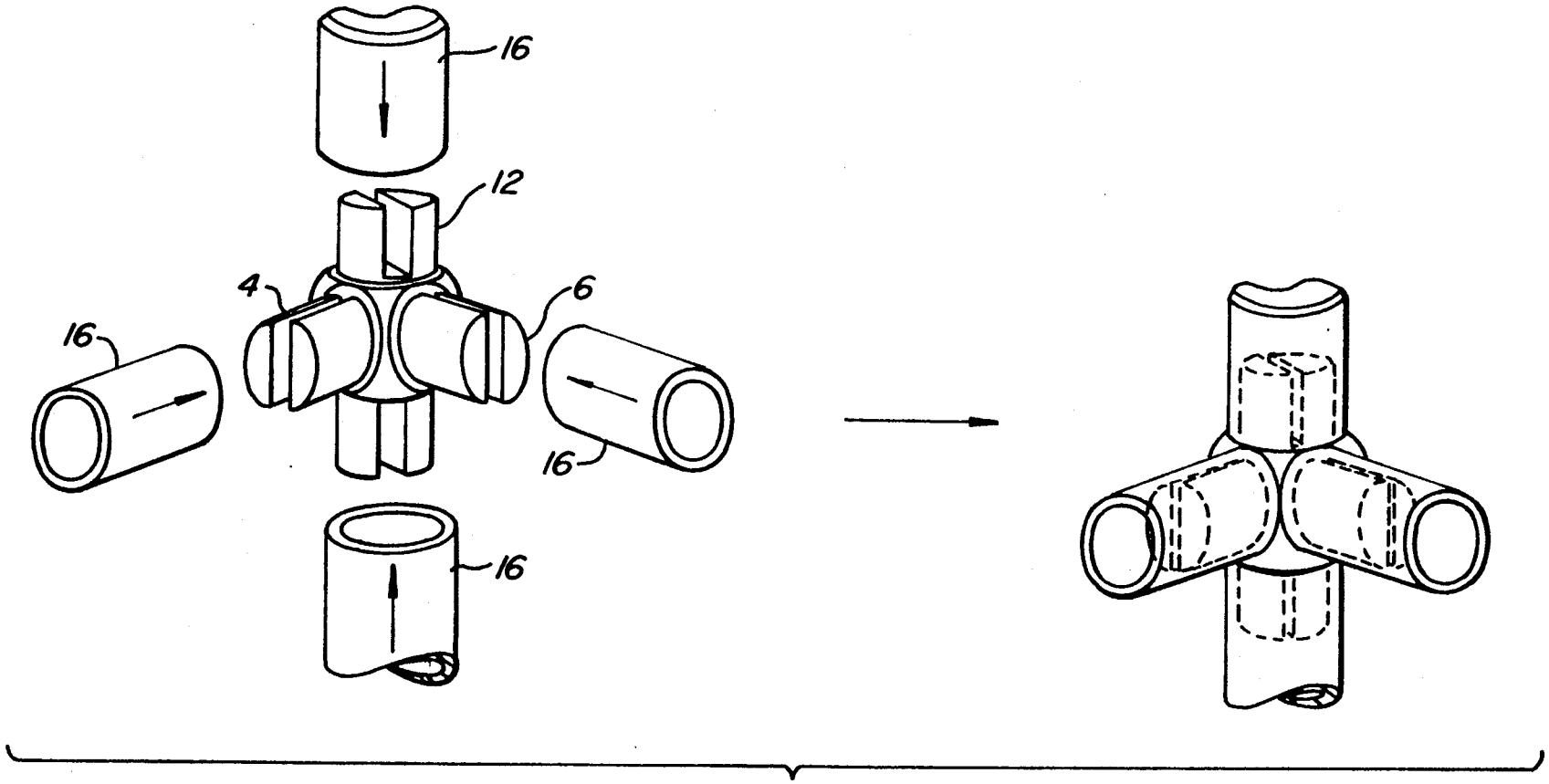
FIG. 2 illustrates the use of the connector system in connecting pipe thereto.

FIG. 2 illustrates use of the particular connector shown in FIG. 1A in a pipe structure. The connector shown in FIG. 1B will be similarly connected, but will not have a pipe extending from either the top or bottom thereof. As shown in FIG. 2, the completed pipe connector is provided with pipes 16 which are inserted over each of the pins 4 and 6 as well as over each end of the insertable through pin 12. While in some embodiments, the compression fitting formed by the pins and the pipe will provide sufficient structural strength, in some embodiments, it will be desirable to glue or otherwise secure the pipes to the pins. The resulting structure is shown in the right-hand portion of FIG. 2.

The preferred material for fabrication of the pipe connectors and the pipes to be attached thereto is PVC plastic, ABS plastic, or the like due to its low cost. The methods for forming such PVC parts are well known to those of skill in the art. However, in some embodiments, the connectors/pipes will be fabricated from metal, wood, or the like.

Figure 3A:
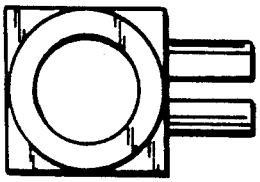
FIGS. 3A to 3D and 3E illustrate various body types which will find use in connection with the invention.
Figure 3B:
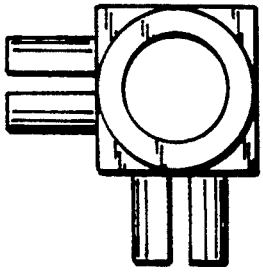
Figure 3C:
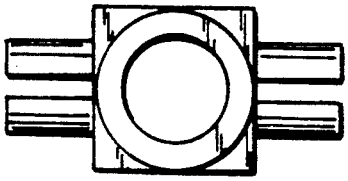
Figure 3D:
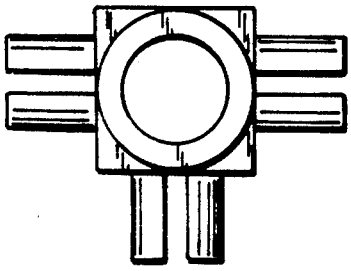
Figure 3E:
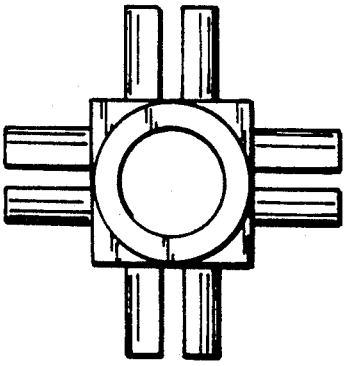

FIGS. 3A to 3F illustrate various body types which will be used in connection with the through and end pins illustrated above. The bodies are shown in top view in FIG. 3. In particular, FIG. 3A illustrates a body with only a single pin extending therefrom, which will be useful in top and center connections of sheet type structures. FIG. 3B illustrates a second body type like the one shown in FIG. 1 in which pins extend at 90° angles from the body. FIG. 3C illustrates a body type which will be useful in the fabrication of large sheets or walls of structures which includes two pins extending from the body at 180° angles. FIGS. 3D and 3F illustrate, respectively, bodies with three and four pins oriented at right angles from each other.

Figure 4A:
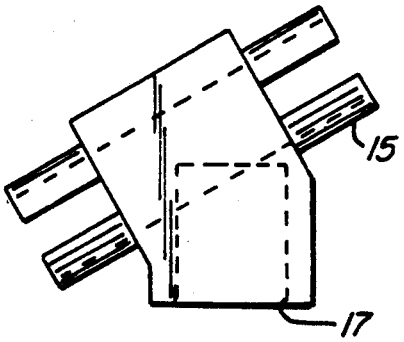
FIGS. 4A and 4B illustrate roof connection bodies.
Figure 4B:
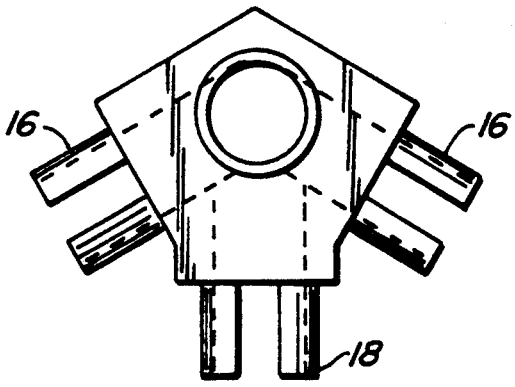

FIGS. 4A and 4B illustrate bodies which will find use in construction of roof or other similar structures. FIG. 4A illustrates an end portion with molded, integral pin connectors 15 thereon, preferably having slots like the pin connectors. This part is used for formation of roof pitch at the top of a wall. A hole 17 on the bottom receives the pin from a corner connector such as shown in FIG. 1. FIG. 4B illustrates a center or peak portion which will find use in the top portion of a roof-like structure at either a middle or end location thereof, depending upon whether a through or end pin is inserted in the aperture therein. As shown, the roof connector pins and apertures are oriented at angles other than 90° such that sloped roof structures may be fabricated therewith. For example, in FIG. 4B the pins 16 are oriented at an angle of about 30° from the vertical pin 18.

B. Connector Kits

Figure 5:
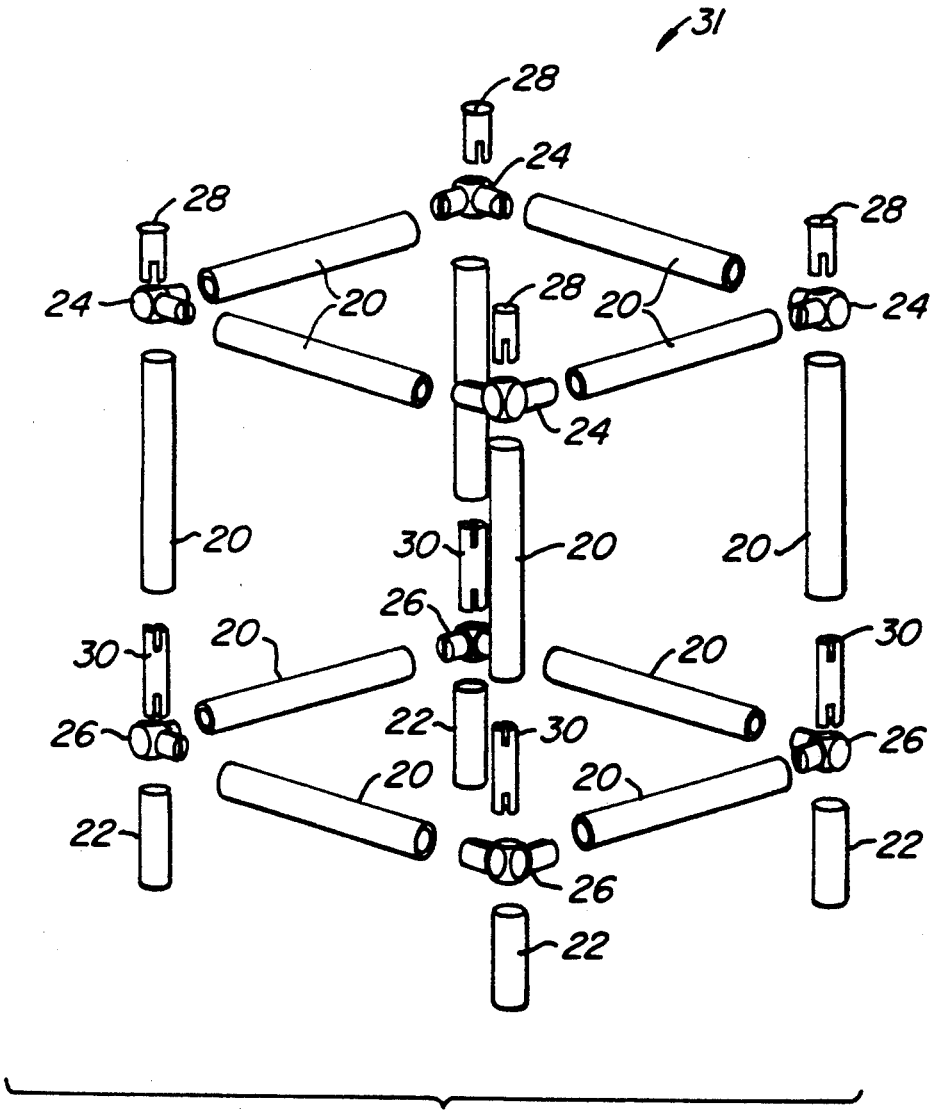
FIG. 5 illustrates a pipe structure kit.

In one embodiment, the various connectors illustrated above will generally be sold as a connector kit or as a part of a kit for a specific structure. FIG. 5 illustrates an exploded view of a simple kit which might be provided by a manufacturer for a plant stand, table, or similar structure using the connectors illustrated above. As shown therein, the kit would include pre-cut PVC pipes 20 and 22. Of course, the horizontal and vertical members 20 may be of different lengths. Conveniently, in one embodiment the sum of the pipe lengths is the same as a standard uncut pipe length. Only one body type is required such as the one shown in FIG. 1 for construction of the structure in FIG. 5. This connector body is utilized at both end locations 24 where pipes extend vertically in only one direction from the connector and at internal location 26 where pipes extend in two directions from the connector. End pins 28 are used at the end locations and through pins 30 are used at the central locations.

Figure 6:
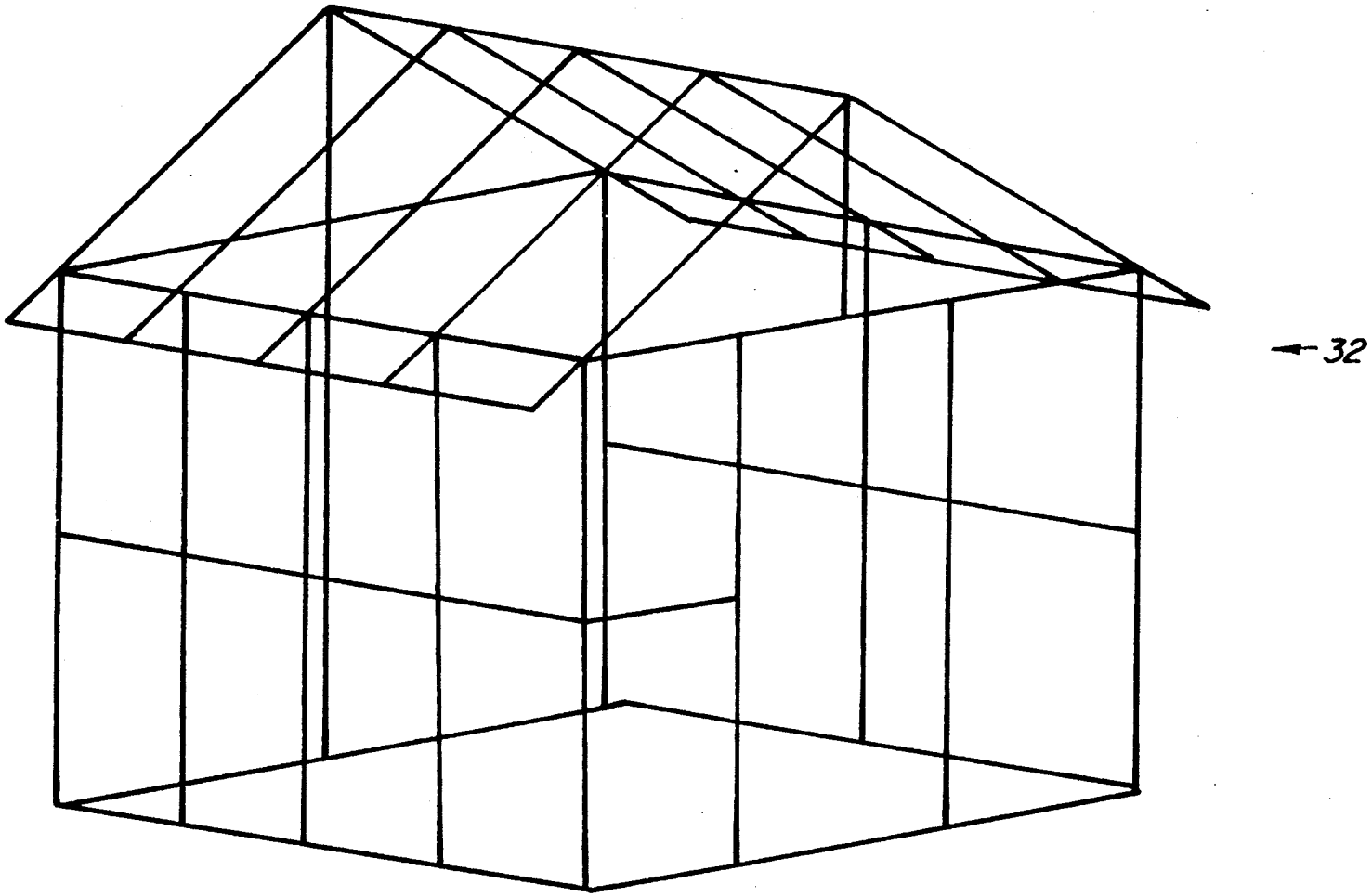
FIG. 6 illustrates a completed shelter constructed with the connectors disclosed herein.

Of course, FIG. 5 illustrates only the simplest of structures which may be constructed using the connectors disclosed herein. FIG. 6 illustrates a more complex shelter structure 32 which may be constructed using only a few of the connector parts disclosed herein, i.e., the through and end pins, the two roof parts, and the bodies shown in FIGS. 3A, 3B, and 3C. As shown, the use of a few connector bodies in combination with the two pin types disclosed herein provides for construction of fairly complex structures.

Figure 7:
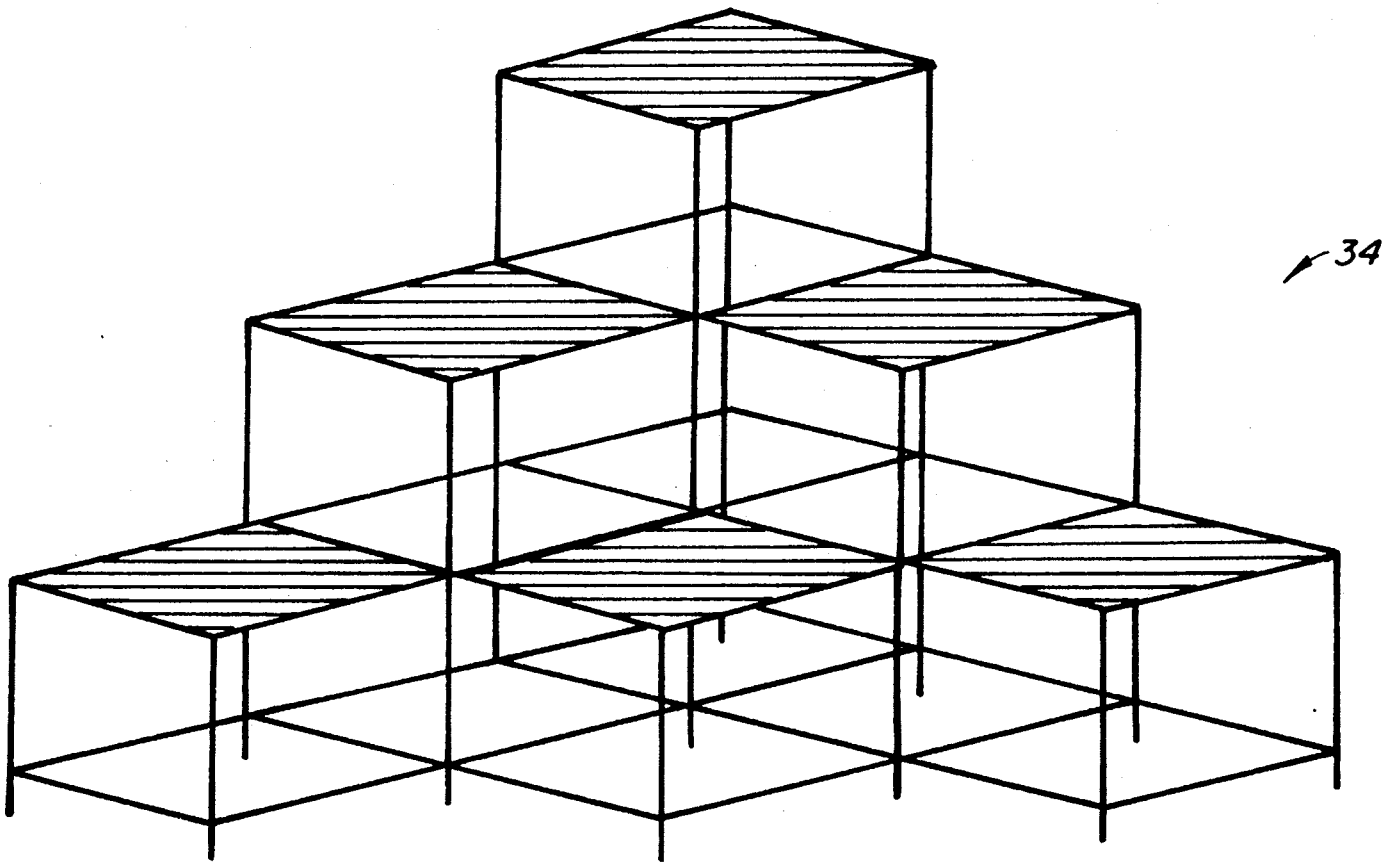
FIG. 7 illustrates a completed structure constructed with the connectors disclosed herein.

FIG. 7 illustrates a more complex plant stand or other structure 34 which is constructed using only the through and end pins, and the body shown in FIG. 3B. It is seen that very complex structures and kits therefore may be provided while only fabricating a few parts for connection thereof. In particular, for each body type used in construction of a structure, the pin structure provided herein essentially provides two connector types, i.e., those for internal and those for end connections. Accordingly, manufacturing costs can be substantially reduced.

The above description is illustrative and not restrictive. Many variations of the invention will become apparent to those of skill in the art upon review of this disclosure. Merely by way of example a wide variety of materials may be used in the fabrication of the various parts disclosed herein and a wide variety of structures may be fabricated using the connectors disclosed herein. The scope of the invention should, therefore, be determined not with reference to the above description, but instead should be determined with reference to the appended claims along with their full scope of equivalents.

What is claimed is:

1. A connector kit for construction of structures using pipe comprising:

a) plurality of first connector bodies comprising apertures of a first cross-section and at least one pin extending therefrom, said at least one pin having a second cross-section of substantially the inside cross-section of said pipe;

b) a plurality of first connector pins having a center portion of substantially said first cross-section for insertion into said aperture, and first and second ends of said second cross-section, said first and second ends extending from said body when said first connector pin is inserted into said first connector body, and a stop for limiting the insertion of said pin into said apertures; and c) a plurality of second connector pins having a first end of substantially said first cross-section for insertion into said aperture and a second end of said second cross-section, said second end extending from said body when said second connector pin is inserted into said first connector body.

2. A connector kit for construction of structures using pipe comprising:

a) a plurality of first connector bodies comprising apertures of a first cross-section and at least one pin extending therefrom, said at least one pin having a second cross-section of substantially the inside cross-section of said pipe;

b) a plurality of first connector pins having a center portion of substantially said first cross-section for insertion into said aperture, and first and second ends of said second cross-section, said first and second ends extending from said body when said first connector pin is inserted into said first connector body; and c) a plurality of second connector pins having a first end of substantially said first cross-section for insertion into said aperture and a second end of said second cross-section, said second end extending from said body when said second connector pin is inserted into said first connector body, and a stop for limiting the insertion of said pins into said apertures.

3. A kit as recited in claim 1 or 2 wherein said first connector bodies have two of said pins extending therefrom, said two pins extending from said body at right angles to each other in a common plane and each of said two pins extending from said body at right angles to said apertures.

4. A kit as recited in claim 3 further comprising second connector bodies, said second connector bodies having an aperture therethrough and a single pin extending therefrom, said single pin extending from said body at a right angle to said aperture.

5. A kit as recited in claim 3 further comprising second connector bodies, said second connector bodies having an aperture therethrough and two pins extending therefrom, said two pins oriented at substantially a 180° angle from each other in a common plane, each of said two pins oriented at right angles to said aperture.

6. A kit as recited in claim 3 further comprising second connector bodies, said second connector bodies having an aperture therethrough and three pins extending therefrom, said three pins in a common plane and oriented at right angles to each other, each of said pins oriented at right angles to said aperture.

7. A kit as recited in claim 3 further comprising second connector bodies, said second connector bodies having an aperture therethrough and four pins extending therefrom, said four pins in a common plane and oriented at right angles to each other, each of said pins oriented at right angles to said aperture.

8. A kit as recited in claim 3 further comprising roof connector bodies, said roof connector bodies comprising a center aperture and at least two pins extending therefrom, said two pins lying in a common plane and having an angle therebetween of more than 90° but less than 180°, said pins oriented at right angles to said aperture.

* * * * *